US006578627B1

(12) United States Patent
Liu et al.

(10) Patent No.: US 6,578,627 B1
(45) Date of Patent: Jun. 17, 2003

(54) PATTERN WITH RIBBED VORTEX GENERATOR

(75) Inventors: Min-Sheng Liu, Hsinchu (TW); Chi-Chung Wang, Hsinchu (TW); Yu-Juei Chang, Hsinchu (TW); Jane-Sunn Liaw, TaiChung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/028,615

(22) Filed: Dec. 28, 2001

(51) Int. Cl.[7] ..... F28F 13/12
(52) U.S. Cl. ..... 165/109.1; 165/151
(58) Field of Search ..... 165/109.1, 151

(56) References Cited

U.S. PATENT DOCUMENTS 1,575,864 A * 3/1926 Owston ..... 165/151
1,927,325 A * 9/1933 Ritter ..... 165/151
3,741,285 A * 6/1973 Kuethe ..... 165/109.1
4,787,442 A * 11/1988 Esformes ..... 165/151
4,984,626 A * 1/1991 Esformes et al. ..... 165/151
4,997,036 A * 3/1991 Schulze et al. ..... 165/151
5,361,828 A * 11/1994 Lee et al. ..... 165/109.1
6,349,761 B1 * 2/2002 Liu et al. ..... 165/150

* cited by examiner

*Primary Examiner*—Allen Flanigan
(74) *Attorney, Agent, or Firm*—Troxell Law Office PLLC

(57) ABSTRACT

A new fin pattern of a ribbed vortex generator for use in an air conditioner or heat exchanger. It has multiple protruding turbulent prisms placed around a round tube on a radiation fin. Each protruding turbulent prism is strip rib-shaped 3D structure with one end higher and the other end lower. Each of the multiple protruding turbulent prisms is placed around the round tube at proper intervals, and oriented to the direction that fluid flows. The higher ends of a first pair of prisms are placed on the front end entrance of the round tube and the higher ends of a second pair of prisms are placed on the exit, which improves the heat transfer but causes little pressure drop-off.

19 Claims, 8 Drawing Sheets

| Re(Based on the height of path) | Pressure drop-off for plane board style fin (Pa) | Pressure drop-off for ribbed vortex generator (Pa) | Pressure drop-off for VG5 vortex generator (Pa) |
|---|---|---|---|
| 500 | 0.935 | 1.040 | 1.209 |
| 1000 | 1.098 | 1.274 | 1.446 |
| 1500 | 1.759 | 2.169 | 2.628 |
| 2000 | 3.063 | 3.618 | 4.540 |
| 2500 | 4.251 | 5.329 | 7.090 |
| 3330 | 7.432 | 9.109 | 12.232 |
| 4000 | 10.627 | 12.789 | 16.429 |
| 5000 | 16.584 | 19.362 | 24.891 |

PATTERN WITH RIBBED VORTEX GENERATOR

BACKGROUND OF THE INVENTION

1. Field of the Invention

The present invention relates to a new fin pattern of a ribbed vortex generator. Especially, the present invention relates to a new fin pattern of a ribbed vortex generator that applies most often in air conditioners and air-cooling heat exchangers to generate turbulence and to improve heat transfer.

2. Description of the Prior Art

In recent years, the application of vortex generators in heat exchangers has received much attention. In order to increase overall performance of heat transfer, many improvements on the application of enhanced surface have been developed. In the article by M. Fibig in 1998 "Vortices, generators and heat transfer, Trans.IchemE", there are three major improvements of surface application to enhance the performance of heat transfer, namely (1) developing boundary layer, (2) swirl or vortices, (3) flow destabilization or turbulence intensification. In 2000, Dr. Chi-Chun Wang in his article "Technology review—a survey of the recent progress of the patents of fin-and-tube Heat Exchanges, J. of Enhanced Heat Transfer" mentioned that the most common surface improvements in heat transfer are interrupted surfaces, as slits, offset strips, and louvers. The interrupted surface technology improves the performance of heat transfer extremely; however, the associated penalty of pressure drop is also tremendous. Comparing with interrupted surface technology, vortex generators not only keep the advantage of the three major mechanisms but also reveals comparatively small pressure drops. That is because the friction on surface is related to spanwise and normal velocities instead of streamwise velocity. The vortex generators characterized the secondary flow pattern from the vertical motion is caused by the spanwise and normal velocities. Heat transfer enhancement is associated with the secondary flow but with a lower penalty of friction. Therefore, longitudinal vortices are recognized especially suitable for heat transfer applications.

The article related to the improvement of heat transfer is seen earliest in "The improvement of forced convection surface heat transfer using surface protrusions in the form of (A) cubes and (B) vortex generators." by Edwards and Alker in 1974. In the article, it mentioned that the coefficient of partial heat transfer could be higher than that of plane fin surface by 40%.

Therefore, to increase the performance of the flow destabilization and the turbulence intensification will also increase the performance of air flow mixing. The problem of how to increase the performance of the flow destabilization and the turbulence intensification to obtain the best heat transfer performance, but still keep the pressure drop to the minimum level, is a critical issue in surface application. Meanwhile, the improvement of the shape of a vortex generator is an important topic in development.

The inventor of the present invention is identical to the inventor in ROC patent 446109. In the case of ROC patent 446109, some curve-shaped protruding turbulent cubes are placed around the heat transfer fin to enhance the heat transfer performance. According to the test, there is much improvement therewith.

SUMMARY OF THE INVENTION

The present invention relates to a new fin pattern of a ribbed vortex generator which includes non-equal-height rib-shaped prism-like structure (prisms) placed on fin of a vortex generator. When the fluid flows thru heat exchanger, the prisms of the vortex generator will create vortices to enhance the performance of the flow destabilization and the turbulence intensification but with much less pressure drop and further mix the fluid flowing to obtain the best heat transfer performance.

In order to achieve the purpose described above, in one embodiment of the present invention, there are multiple prisms placed around the round tube of the vortex generator. The height of two ends of the prism is not equal, which means one end is higher and another end is lower. The prisms are placed around the round tube on the fin of the vortex generator concentric with the center of the round tube. A first pair of the prisms forms a fluid entry and a second pair of the prisms forms a fluid exit. The fluid will be led into the entry formed by a higher end of the first pair of prisms, flow along the path formed by the round tube and the vortex generator, and leave from the exit formed by the higher end of the second pair of prisms. So, the disturbing performance is enhanced during the fluid flowing, and the heat around the back end of the round tube will be brought away as well, however, the pressure drop is relatively much less. Additionally, vortices will be created when fluid flows thru the path, which causes more extra air be drawn into the area of the fin of the heat exchanger and further improves the performance of heat transfer.

The appended drawings will provide further illustration of the present invention, together with the description, serve to explain the principles of the invention.

DETAILED DESCRIPTION OF THE PREFERRED EMBODIMENT

The following embodiments will illustrate detail information of the operation, the method and the performance of the ribbed vortex generator of the present invention.

The present invention relates to a new fin pattern of a ribbed vortex generator which uses a plurality of prism-like structures (prisms) placed on a fin of a vortex generator. In the present invention, there are multiple strip rib-shaped protruding prisms placed around round tube of the vortex generator. The height of two ends of the prisms is not equal, one end is higher and another is lower. The prisms are placed around the round tube on the fin of the vortex generator with proper distance from each other. The higher end of a first pair of prisms forms a fluid entrance and the higher end of a second pair of prisms forms a fluid exit. The fluid will be led into the entrance formed by the higher end of the first pair of prisms, flow along the path formed by the round tube and the vortex generator, and leave from the exit formed by the higher end of the second pair of prisms. So, the disturbing performance is enhanced during fluid flowing thru, however, the pressure drop is relatively much less.

In prior art, most of time, a heat exchanger is with multiple radiation fins placed at intervals and with parallel, and the fluid flowing between the parallel fins for heat transfer. To make it simple, in the following embodiments of the present invention, only single fin vortex generator will be introduced. However, the present invention certainly covers the multiple fins vortex generator used in heat exchanger.

Figure 1:
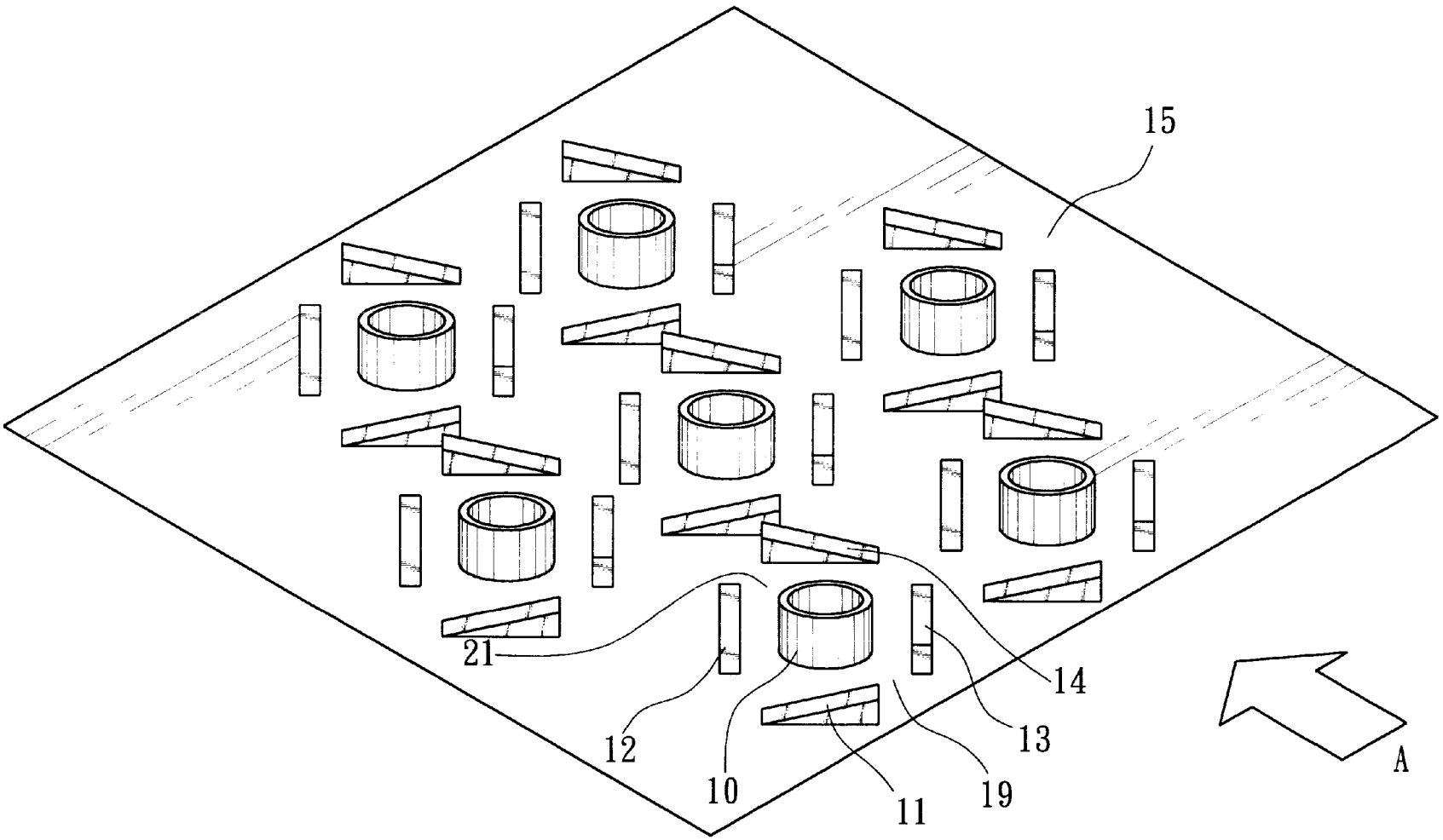
FIG. 1 shows a 3D diagram of a preferred embodiment of the present invention of the ribbed vortex generator with one single fin.
Figure 2:
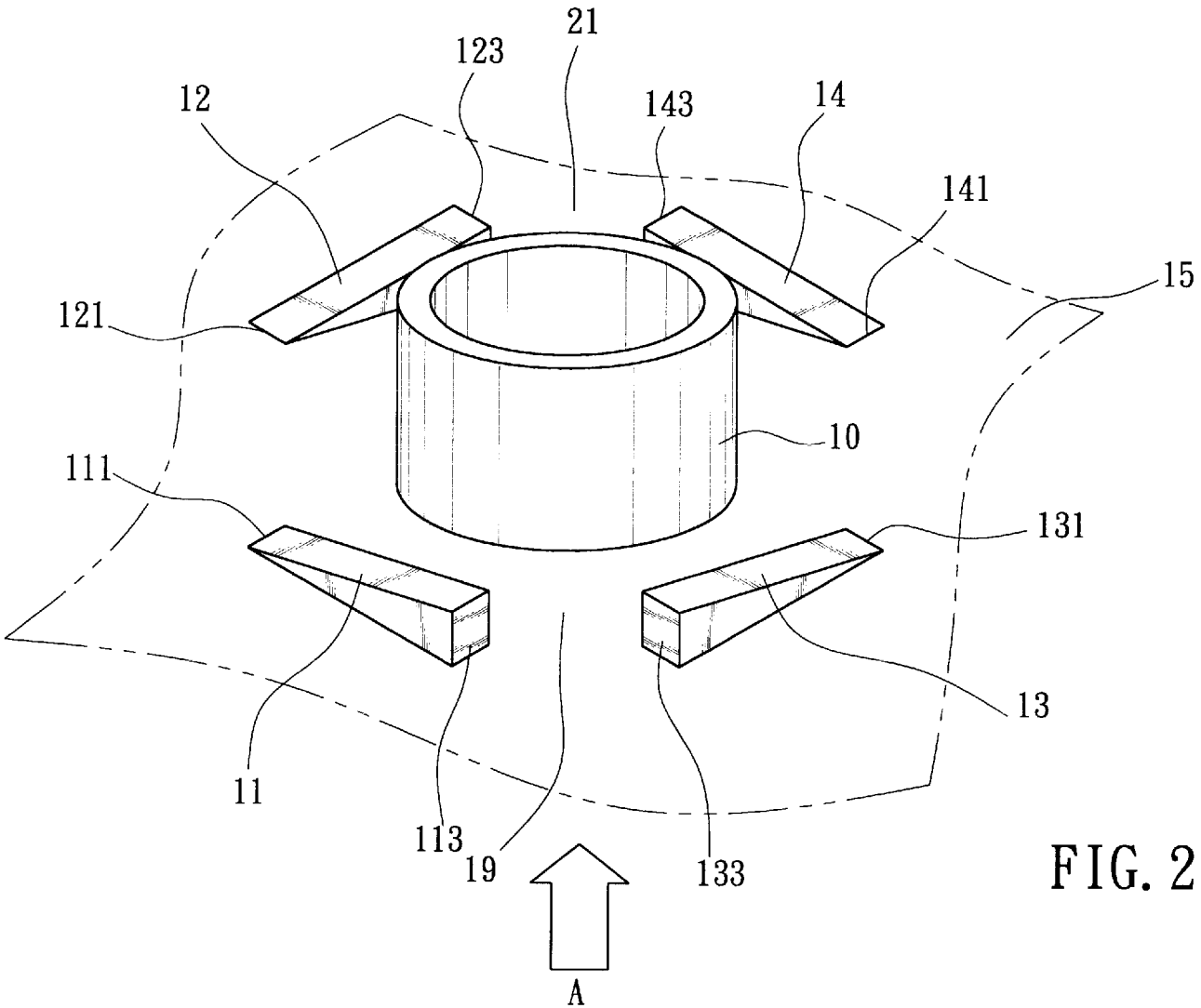
FIG. 2 shows a partial enlarged diagram of one ribbed vortex generator and a round tube.

Please refer to FIG. 1 and FIG. 2, which is a preferred embodiment of the present invention with one single fin 15. As shown, there are many round tubes 10 place on said single fin 15. The said round tubes 10 are placed on said single fin 15 in stagger arrangement. Every round tube 10 is with a ribbed vortex generator place around. The said round tubes 10 and their corresponding ribbed vortex generators are placed around on the surface of said fin 15 to increase the performance of flow destabilization and turbulence intensification. When fluid flowing along the direction A, a fluid entrance 19 on the front end of said round tube 10 and a fluid exit 12 on the back end of said round tube 10 will be defined.

Every ribbed vortex generator comprises several protruding prisms. In the embodiment, each ribbed vortex generator comprises four protruding prisms. there are the first protruding prism 11, the second protruding prism 12, the third protruding prism 13 and the fourth protruding prism 14. in other embodiments, a ribbed vortex generator can comprise different number of protruding turbulent prisms. As shown, each protruding turbulent prism 11, 12, 13, and 14 is in strip and rib shaped. The height of the two ends of the protruding turbulent prisms is different; one is higher and another is lower, while the width is the same. The higher end is 113, 123, 133 and 143 respectively and the lower end is 111, 121, 131 and 141 respectively. The protruding turbulent prisms 11, 12, 13 and 14 are placed around the round tube 10 with proper interval. In this embodiment, the round tube 10 is round tube shape, it will be better if the protruding turbulent prisms 11, 12, 13 and 14 are placed along the direction of the extension thereof parallel with the tangent line of the round tube 10, and equally dividing the circle with the center of the round tube 10. More, the higher ends 113 and 133 of the paired protruding turbulent prisms 11 and 13 placed on the front end entrance 19 of the round tube 10 is facing the entrance 19, and the higher ends 123 and 143 of the paired protruding turbulent prisms 12 and 14 placed on the back end exit 21 of the round tube 10 is facing said exit 21, so, the lower end 111, 121, 131 and 141 of the protruding turbulent prisms 11, 12, 13 and 14 will be placed beside the round tube 10 as well as between the entrance 19 and the exit 21. In this embodiment, the height of the lower end 111, 121, 131 and 141 of the protruding turbulent prisms 11, 12, 13 and 14 is very short and close to the surface of the fin 15, but it certainly could be a little higher than the surface of the fin 15.

Figure 3:
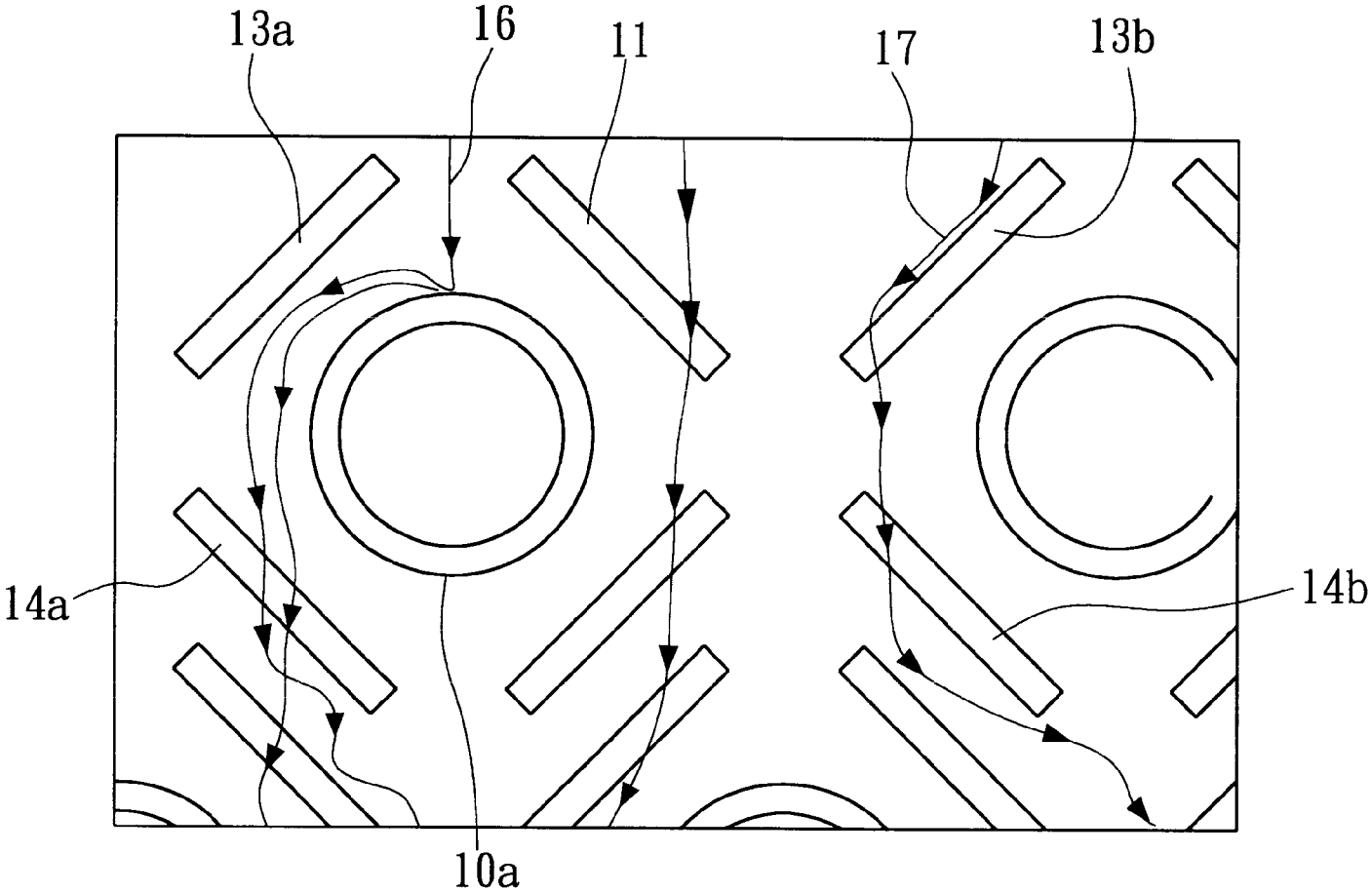
FIG. 3 shows a diagram of fluid flowing track between a ribbed vortex generator and a round tube on the surface of the fin with dyes injection technique.

A shown in FIG. 3, which is a diagram of fluid flowing track between two paired ribbed vortex generator and a round tube on the surface of the fin with dyes injection technique. In which, the Reynolds number is set up to Re=1000, the heat exchanger is an enlarged size fin-and-tube style heat exchanger placed in a stagger arrangement. When fluid entering said heat exchanger, the influence of the third protruding turbulent prism 13*a*, a counter-rotating vortex has been created, which improve the fluid flowing and heat transfer performance. Meanwhile, the fluid flow hitting the third protruding turbulent prism 13*b* on the other ribbed vortex generator also create a counter-rotating vortex, and when the counter-rotating vortex flowing thru the fourth protruding turbulent prism 14*b*, it will change the direction that the vortex rotate. The change will draw in a lot fresh air to the surface of the heat exchanger to increase the heat transfer.

Figure 4:
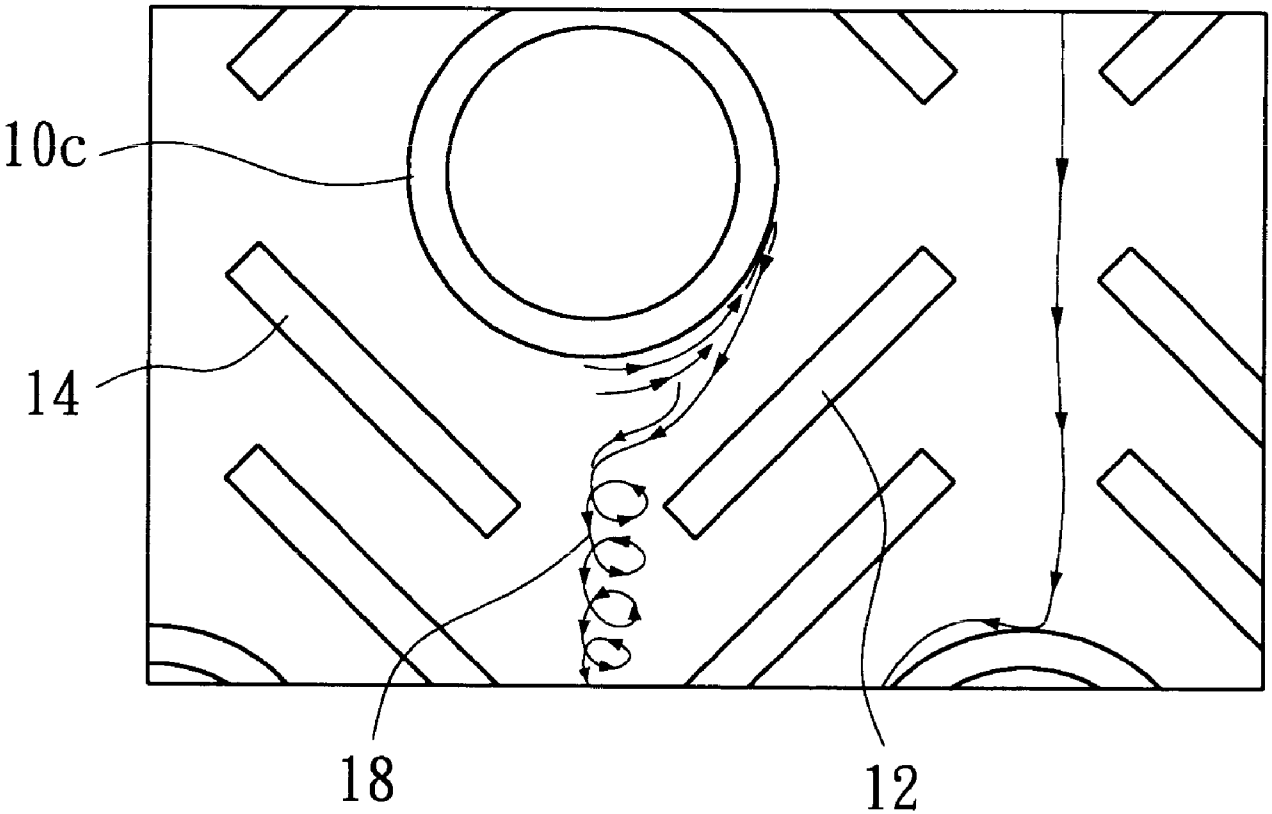
FIG. 4 shows a diagram of fluid flowing track between a ribbed vortex generator and the back end of a round tube on the surface of the fin with dyes injection technique.

FIG. 4 shows a diagram of fluid flowing track between a ribbed vortex generator and the back end of a round tube on the surface of the fin with dyes injection technique. As shown, there is a vortex 18 generated in the back of the round tube 10*c*, the vortex 18 will not only improve the heat transfer around the back area of said round tube 10*c* but also draw in the fresh air to the surface of the heat exchanger to improve the heat transfer performance. It is different than the conventional louver fin and slit heat exchanger, which improves the heat transfer but causing an extreme pressure drop. Not like the conventional method, the present invention improves the heat transfer but not causing too much pressure drop.

Figure 5:
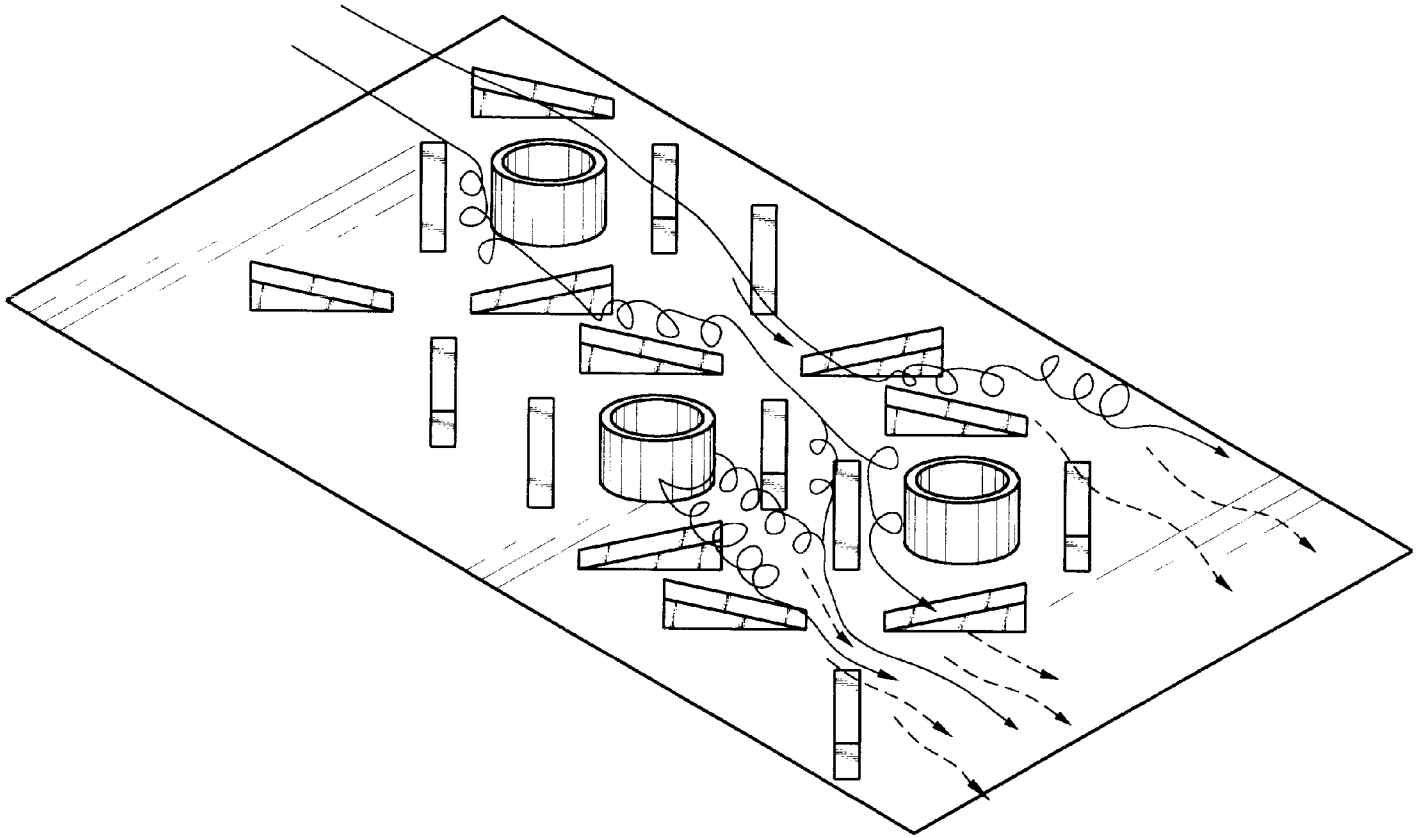
FIG. 5 shown a diagram of fluid flowing track on the surface of the fin with dyes injection technique.

FIG. 5 shows a diagram of fluid flowing track on the surface of the fin with dyes injection technique. The diagram is based on an experiment. Comparing with the FIG. 3 and FIG. 4, FIG. 5 is showing that the fluid is led into the entrance formed by said rib-shaped protruding turbulent prisms and the round tube, flowing along with the path formed by the round tube and the vortex generator, and leave from the exit formed by another paired rib-shaped protruding turbulent prisms. Because of the performance of flow destabilization and turbulence intensification, the disturbing is much enhanced during fluid flowing thru and so to improve the heat transfer.

Figures 6A, 6B:
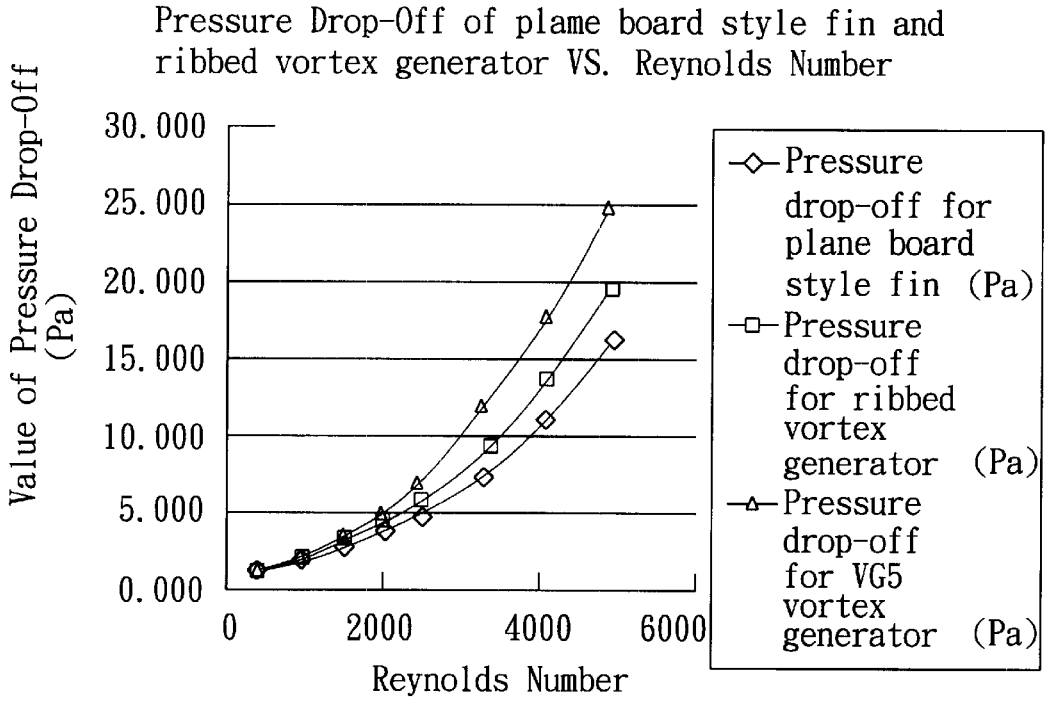
FIG. 6A and FIG. 6B show statistical charts of the experiment of pressure drop applied on the ribbed vortex generator, the plane fine and the VG5 vortex generator.

FIG. 6A and FIG. 6B show statistical charts of the experiment of pressure drop applied on the ribbed vortex generator, the plane fin and the VG5 vortex generator, wherein the VG5 vortex generator is designed with the technology disclosed in ROC patent No. 446109, which is a vortex generator with equal-height curve-shaped protruding turbulent prisms. In the experiment, the Reynolds number is from Re=500 to Re=5000, as shown, the pressure drop value of the present invention is in the middle, which is less than the conventional VG5 vortex generator. So, the embodiment shown in FIG. 5 and FIG. 6 fully fulfill the purpose of the present invention that extremely increasing the heat transfer but with less pressure drop.

Figure 7A:
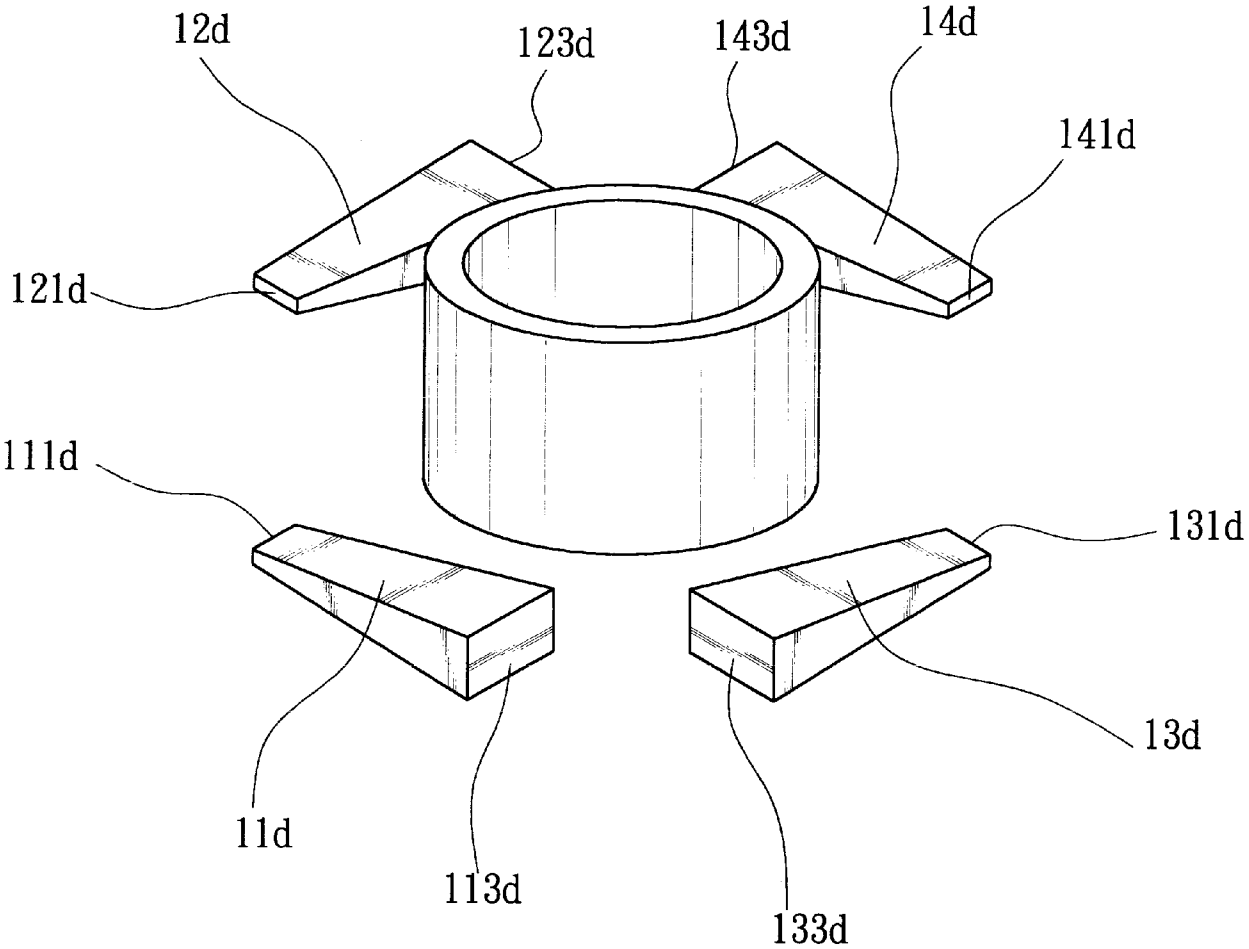
FIGS. 7A and 7B show two different embodiments of the protruding turbulent cubes of the present invention.
Figure 7B:
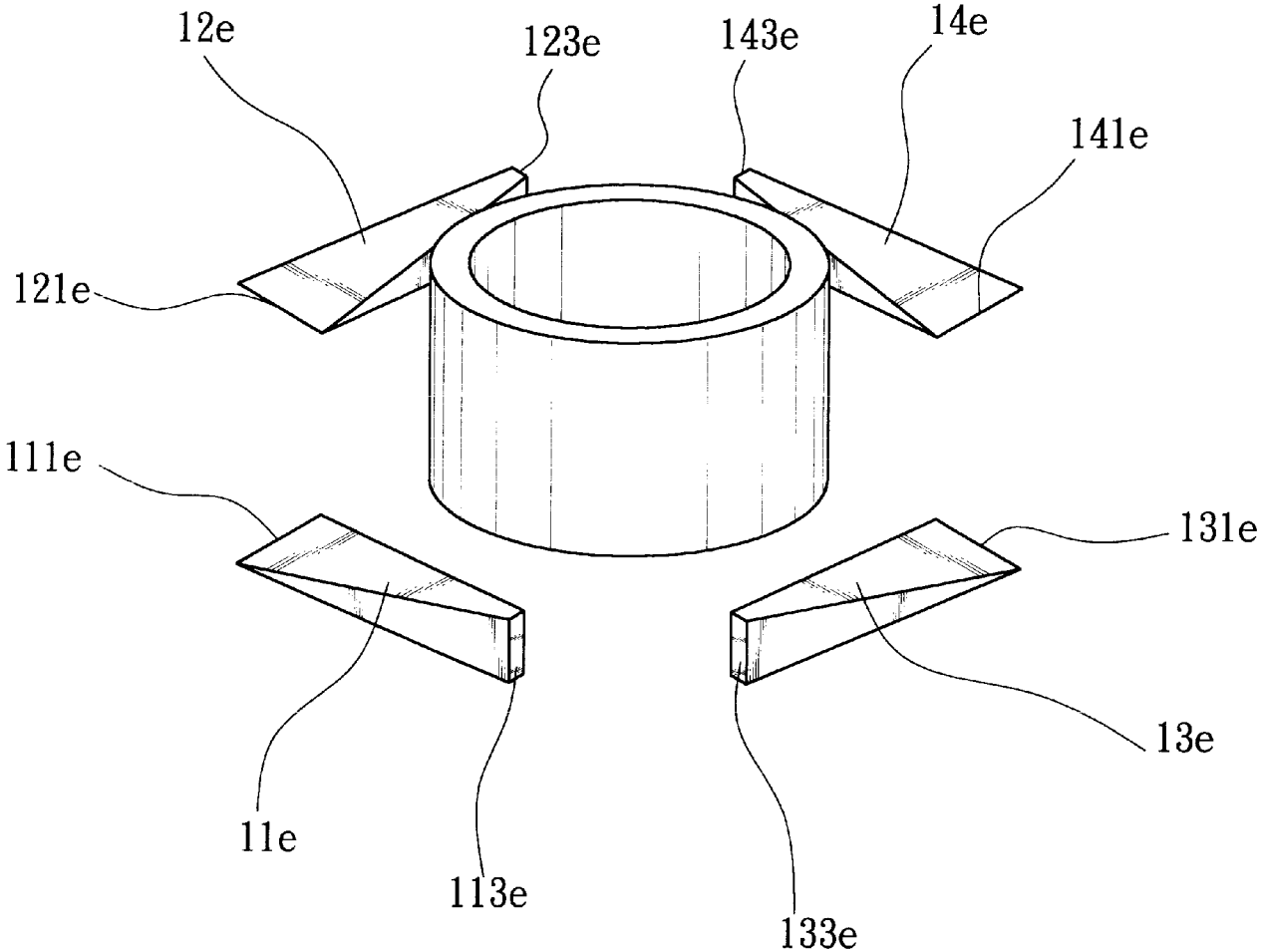

Even in the foregoing preferred embodiments, the protruding turbulent prisms its ends with different height have been illustrated, but different shape protruding turbulent prisms can be used in other embodiment. As shown in FIG. 7A, the protruding turbulent prisms 11*d* and 13*d* are with ends that are different height and width and the width of the higher end 113*d* and 133*d* of the protruding turbulent prisms 11*d* and 13*d* is more than the width of the lower ends 111*d* and 131*d* of the protruding turbulent prisms 11*d* and 13*d*. FIG. 7A is showing another embodiment with the protruding turbulent prisms 11*e* and 13*e*, wherein, the width of the higher end 113*e* and 133*e* of the protruding turbulent prisms 11*e* and 13*e* is less than the width of the lower ends 111*d* and 131*d* of the protruding turbulent prisms 11*e* and 13*e*.

While the present invention has been shown and described with reference to a preferred embodiment thereof, and in terms of the illustrative drawings, it should be not considered as limited thereby. Various possible modification, omission, and alterations could be conceived of by one skilled in the art to the form and the content of any particular embodiment, without departing from the scope and the spirit of the present invention.

What is claimed is:

1. A fin pattern FOR a ribbed vortex generator comprising:

a) a fin;

b) at least one round tube penetratingly mounted through the fin; and c) a ribbed vortex generator positioned around each tube in a spaced arrangement, each ribbed vortex generator including at least four polyhedron prism protrusions with higher and lower ends, arranged on a concentric circle about the tube such that the higher ends of a pair of adjacent protrusions face in one direction, while the higher ends of an opposed pair on the circle face in an opposite direction.

2. The fin pattern for a ribbed vortex generator according to claim 1, wherein each protrusion has a top surface with four sides.

3. The fin pattern for a ribbed vortex generator according to claim 1, wherein a height of the lower end of each protrusion is adjacent to a surface of the fin.

4. The fin pattern for a ribbed vortex generator according to claim 1, wherein the prism protrusions are equally spaced around the tube and oriented perpendicular to a radius of the tube.

5. The fin pattern for a ribbed vortex generator according to claim 1, wherein the round tubes are placed in a staggered arrangement.

6. The fin pattern for a ribbed vortex generator according to claim 1, wherein the protrusions have a uniform width.

7. The fin pattern for a ribbed vortex generator according to claim 1, wherein the higher and lower ends have different widths.

8. The fin pattern for a ribbed vortex generator according to claim 1, wherein a width of the higher end of each prism protrusion is wider than the lower end of the prism protrusion.

9. The fin pattern for a ribbed vortex generator according to claim 1, wherein a width of the higher end of each protrusion is narrower than the lower end of the protrusion.

10. A fin pattern for a ribbed vortex generator comprising:

a) a plurality of spaced apart fins oriented parallel to one another;

b) at least one round tube penetratingly mounted through the fins; and c) a ribbed vortex generator positioned around each tube in a spaced arrangement, each ribbed vortex generator including at last four polyhedron prism protrusions with higher and lower ends, arranged on a concentric circle about each tube such that the higher ends of a pair of adjacent protrusions face in one direction, while the higher ends of an opposed pair on the circle face in an opposite direction.

11. The fin pattern for a ribbed vortex generator according to claim 10, wherein each protrusion has a top surface with four sides.

12. The fin pattern for a ribbed vortex generator according to claim 10, wherein a height of the lower end of each protrusion is adjacent to a surface of the fin.

13. The fin pattern for a ribbed vortex generator according to claim 10, wherein the prism protrusions are equally spaced around the tube and oriented perpendicular to a radius of the tube.

14. The fin pattern for a ribbed vortex generator according to claim 10, wherein the round tubes are placed in a staggered arrangement.

15. The fin pattern for a ribbed vortex generator according to claim 10, wherein a height of the high end of each prism protrusion is half a distance between a pair of fins.

16. The fin pattern for a ribbed vortex generator according to claim 10, wherein the protrusions have a uniform width.

17. The fin pattern for a ribbed vortex generator according to claim 10, wherein the higher and lower ends have different widths.

18. The fin pattern for a ribbed vortex generator according to claim 10, wherein a width of the higher end of each protrusion is wider than the lower end of the protrusion.

19. The fin pattern for a ribbed vortex generator according to claim 10, wherein a width of the higher end of each protrusion is narrower than the lower end of the protrusion.

* * * * *